US005685909A

United States Patent [19]

Reich et al.

[11] Patent Number: 5,685,909

[45] Date of Patent: Nov. 11, 1997

[54] DEVICE FOR PRODUCING PAPER WEBS COATED ON BOTH SIDES

[75] Inventors: Stefan Reich; Bernd Riepenhausen; Martin Kustermann; Michael Trefz, all of Heidenheim, Germany; Lars Winter, Sundsvall, Sweden; Irene Wedin, Sundsvall, Sweden; Anette Berg, Sundsvall, Sweden; Fredrik Aksnes, Sundsvall, Sweden

[73] Assignees: Voith Sulzer Papiermaschinen GmbH, Germany; SCA Graphic Sundsvall AB, Sweden

[21] Appl. No.: 571,820

[22] PCT Filed: Apr. 28, 1995

[86] PCT No.: PCT/EP95/01627

§ 371 Date: Mar. 21, 1996

§ 102(e) Date: Mar. 21, 1996

[87] PCT Pub. No.: WO95/30049

PCT Pub. Date: Nov. 9, 1995

[30] Foreign Application Priority Data

Apr. 28, 1994 [DE] Germany ..... 44 14 949.2

[51] Int. Cl.[6] ..... B05C 11/00

[52] U.S. Cl. ..... 118/67; 118/68; 118/115; 118/117; 118/118; 118/119; 118/123; 118/126; 118/202; 118/203; 118/222; 118/223; 118/249; 118/255; 118/419; 118/427

[58] Field of Search ..... 118/67, 68, 123, 118/115, 117, 118, 119, 126, 203, 202, 222, 223, 249, 255, 419, 427

[56] References Cited

U.S. PATENT DOCUMENTS

| | | | |
|---|---|---|---|
| 2,970,564 | 2/1961 | Warner | 118/249 |
| 4,548,840 | 10/1985 | States et al. | 427/365 |
| 5,176,955 | 1/1993 | Ejiri et al. | 428/336 |
| 5,271,998 | 12/1993 | Duckett | 428/251 |

FOREIGN PATENT DOCUMENTS

| | | |
|---|---|---|
| 2171934 | 9/1986 | European Pat. Off. . |
| 0427887 | 5/1991 | European Pat. Off. . |
| 0454643 | 10/1991 | European Pat. Off. . |
| 0596365 | 5/1994 | European Pat. Off. . |
| 88421 | 1/1993 | Finland . |
| 91299 | 2/1994 | Finland . |
| 94883 | 7/1995 | Finland . |
| 96338 | 2/1996 | Finland . |
| 2851426 | 6/1979 | Germany . |
| 3006862 | 9/1981 | Germany . |
| 3409681 | 9/1985 | Germany . |

(List continued on next page.)

OTHER PUBLICATIONS

Finnish Examiner's Official Action (and translation of same) dated 12 Sep. 1996.

FI-952004 (English equivalent is U.S. Patent Application No. 08/577,419 filed Dec. 22, 1995.).

German Search Report dated 20 Jan. 1995 (P 44 14 949.2).

JP 61-18467 A., In: Patents Abstracts of Japan, C-353, Jun. 13, 1986, vol. 10, No. 166.

*Primary Examiner*—Bernard Pianalto

*Attorney, Agent, or Firm*—Ostrolenk, Faber, Gerb & Soffen, LLP

[57] ABSTRACT

Disclosed are a process of and an apparatus for producing paper webs coated on both sides, in particular so-called LWC-papers, in a paper making machine. Firstly, one side of the paper web (1) is coated in a first coating station (8) and then dried. Subsequently, the other side of the paper web (1) is coated in a second coating station (25) and then dried. Each coating station (8, 25) includes an application role (10), an opposing roll (11) and an application unit (13) arranged on the application roll for indirectly coating the paper web. The metering of the coating mass on the application roll (10) takes place by means of a smooth roll doctor. The coated paper web (1) is calendered by means of an on-line calendering unit (60).

17 Claims, 4 Drawing Sheets

FOREIGN PATENT DOCUMENTS

| | | |
|---|---|---|
| 3922535 | 2/1990 | Germany . |
| 9100291 | 5/1991 | Germany . |
| 4002256 | 8/1991 | Germany . |
| 9111669 | 12/1991 | Germany . |
| 8717966 | 5/1992 | Germany . |
| 4302437 | 8/1993 | Germany . |
| 9314280 | 1/1994 | Germany . |

FIG. 3
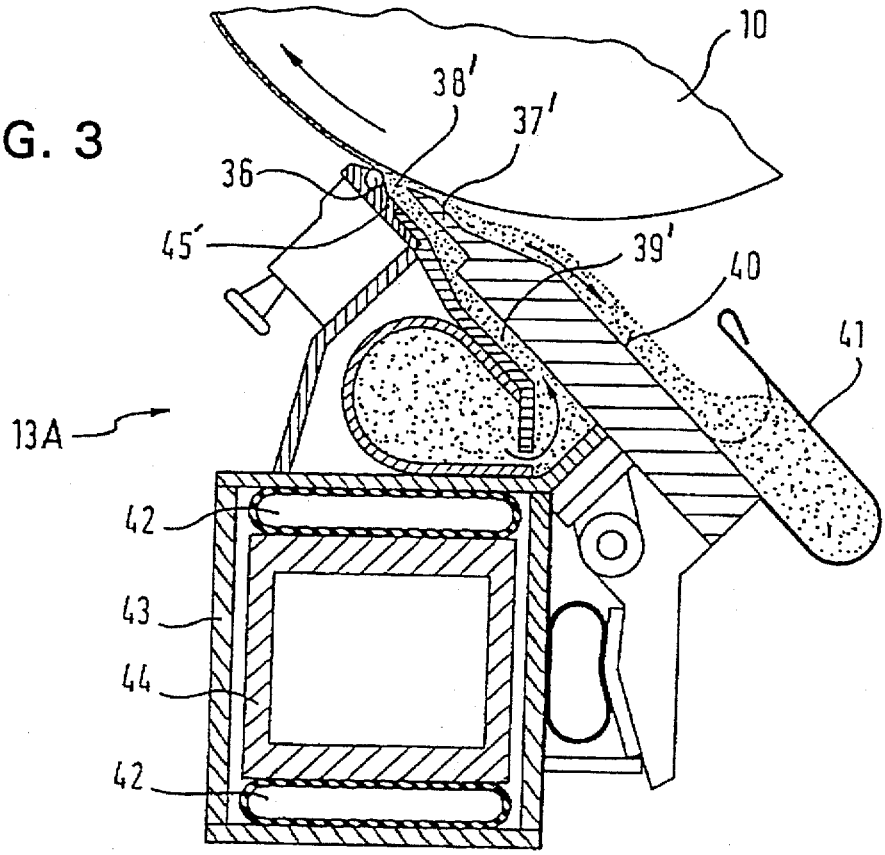
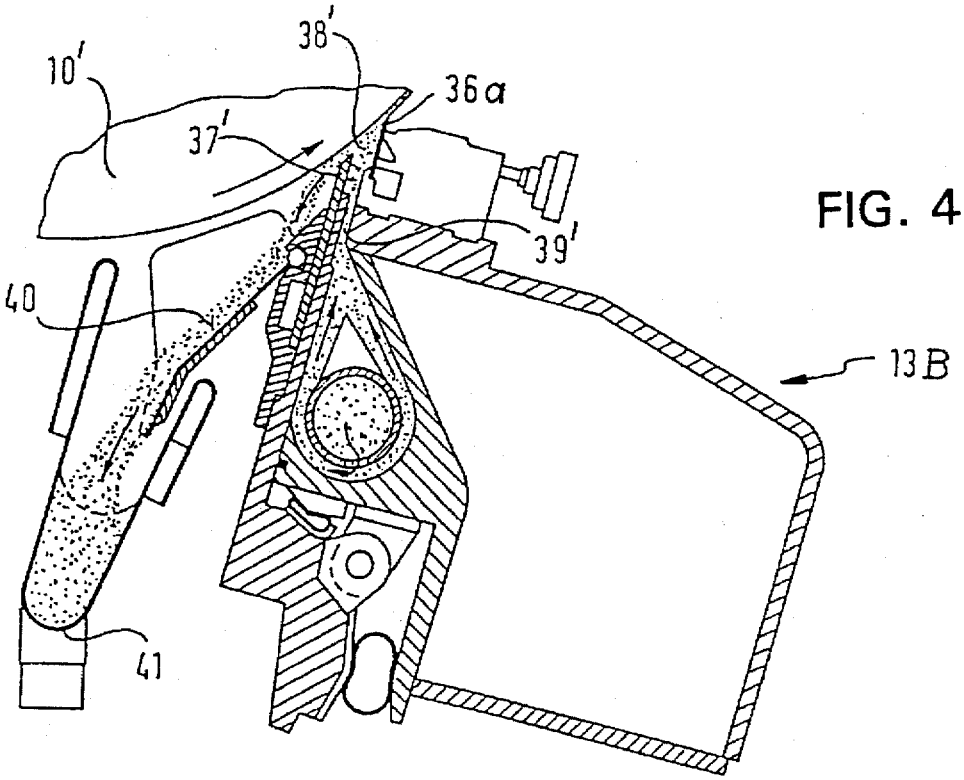
FIG. 4

DEVICE FOR PRODUCING PAPER WEBS COATED ON BOTH SIDES

BACKGROUND OF THE INVENTION

The invention relates to a process for producing paper webs coated on both sides, in particular so-called LWC-papers, in a paper making machine. The invention additionally relates to an apparatus for carrying out such a process.

A process comprising coating one side of a dried paper web in a first application nip between a first application roll and a first opposing element, drying the coating, then coating the other side of the web in a similar second application nip and drying the coating is known from DE 43 02 437 A1. According to FIG. 1 of this publication, the paper web dried in the paper making machine is initially supplied via a smoothing or calendering unit to a first coating plant. In this, one side of the paper web is indirectly coated with a coating mass by means of a first application roll which together with a first opposing roll forms a first application, nip. This takes place by forming a coating film on the shell of the application roll by means of a nozzle application unit and the film is then transferred by the application roll onto the paper web. As a metering element, the coating plant has a roll doctor with a profiled shell surface. The paper web is then dried and supplied to a second coating plant in which the other side of the paper is also indirectly coated. After a further drying process, the finished paper web coated on both sides is rolled up.

A similar process is described in EP 0 596 365 A1 published after the priority date of the present invention.

In DE 43 02 437 A1 already cited, various problems are described which occur in the production of relatively thin paper webs containing recycled paper and intended to be coated on both sides. The present invention is also based on the same problems. However, the known process solves only a part of the described problems. In particular, the known process has not successfully produced a paper web coated on both sides that satisfies high standards, in particular with respect to a uniform smoothness which is as great as possible and with respect to a high gloss.

SUMMARY OF THE INVENTION

The invention is therefore based on the object of further developing the known process to the extent that paper webs coated on both sides can be produced with substantially greater smoothness and gloss values than before. It also forms part of this object to additionally provide an apparatus which is suitable for carrying out this process.

This object is solved by the combination of features of either metering the coating mass onto one of or both of the application rolls using in each case a smooth doctor element and then calendering the web after the second drying step, or as an alternative, calendering after at least partially drying both sides of the web while operating the process at a web speed of at least 900 m/min. The coating is applied to the application roll before the roll surface enters the application nip.

Amongst others, the recognition led to the invention that the use of a smooth doctor element to form the coating film on each of the application rolls in connection with a calendering of the paper web, coated on both sides, by means of at least one calendering unit leads to substantially higher smoothness and/or gloss values than before. It is presumed that this surprisingly good result is achieved in that the use of a smooth doctor element, compared with the commonly known profiled roll doctor, exerts a higher shearing effect on the coating color and that the plate-shaped pigment particles are aligned on account of this in such a manner that they lie flat on the paper surface from the outset. As a result of this, after the following calendering process, there is to a much lesser extent than hitherto the tendency that the surface of the finished paper has a matt characteristic.

The use of a coating blade as a doctor element is possible. However, the use of a smooth roll doctor is preferred because the transverse profile of the coating is capable of being more easily controlled with this, i.e. it succeeds without difficulty to permanently obtain an improved and, in particular, a uniform transverse profile.

A favourable auxiliary effect of the inventive process and the corresponding inventive apparatus consists in that roll doctor bars with a smooth shell surface wear substantially more slowly than those with a profiled shell surface.

Further features can improve the inventive result more. It is particularly important that the calendering takes place at a higher temperature after the coating than was previously the case and that in this case the "relatively soft rolls" used in calendering and which are not capable of being heated are harder than in commonly known "soft nip" calendering units. For example, one can therefore call the inventive calendering units (arranged behind the coating plants) "Super Compact Calenders".

In the subject matter of DE 43 02 437 A1, the rolls of each coating plant are superimposed so that the paper web passes essentially in the horizontal direction through the application nip. This requires a relatively bulky device for pivoting the movable opposing roll. Additionally, a removal of the upper lying opposing roll is necessary when the lower lying application roll must be removed. An important partial feature of the present invention therefore consists in arranging the rolls of at least one of the two coating plants in such a manner that the web travels essentially from below to above, preferably at an angle from below to above through the application gap. The inventive apparatus differs in respect of this also in comparison to the subject matter of EP 0 596 365 A1 in which the web travels at an angle from above to below through the coating gap.

Further, the inventive apparatus makes use of the known possibility to arrange the drying means, which follows each coating plant, above the coating plant. This simplifies heat removal because the heating air flow directed substantially upwards is not hindered by the coating plant. It also avoids soiled cleaning water dropping onto the drying means during cleaning of the coating plant.

Finally, a further advantage resides in the fact that in the case of a possible tearing of the paper, the waste paper running in the direction towards the coating plant falls down under the influence of gravity before reaching the coating plant and therefore cannot collect in front of the application nip.

The invention is described in more detail in the following by means of an exemplary embodiment with reference to the enclosed drawings, in which:

BRIEF DESCRIPTION OF THE DRAWINGS

FIGS. 2–4 respectfully show a schematic cross-sectional view of various application units.

DESCRIPTION OF PREFERRED EMBODIMENTS

Figure 1:
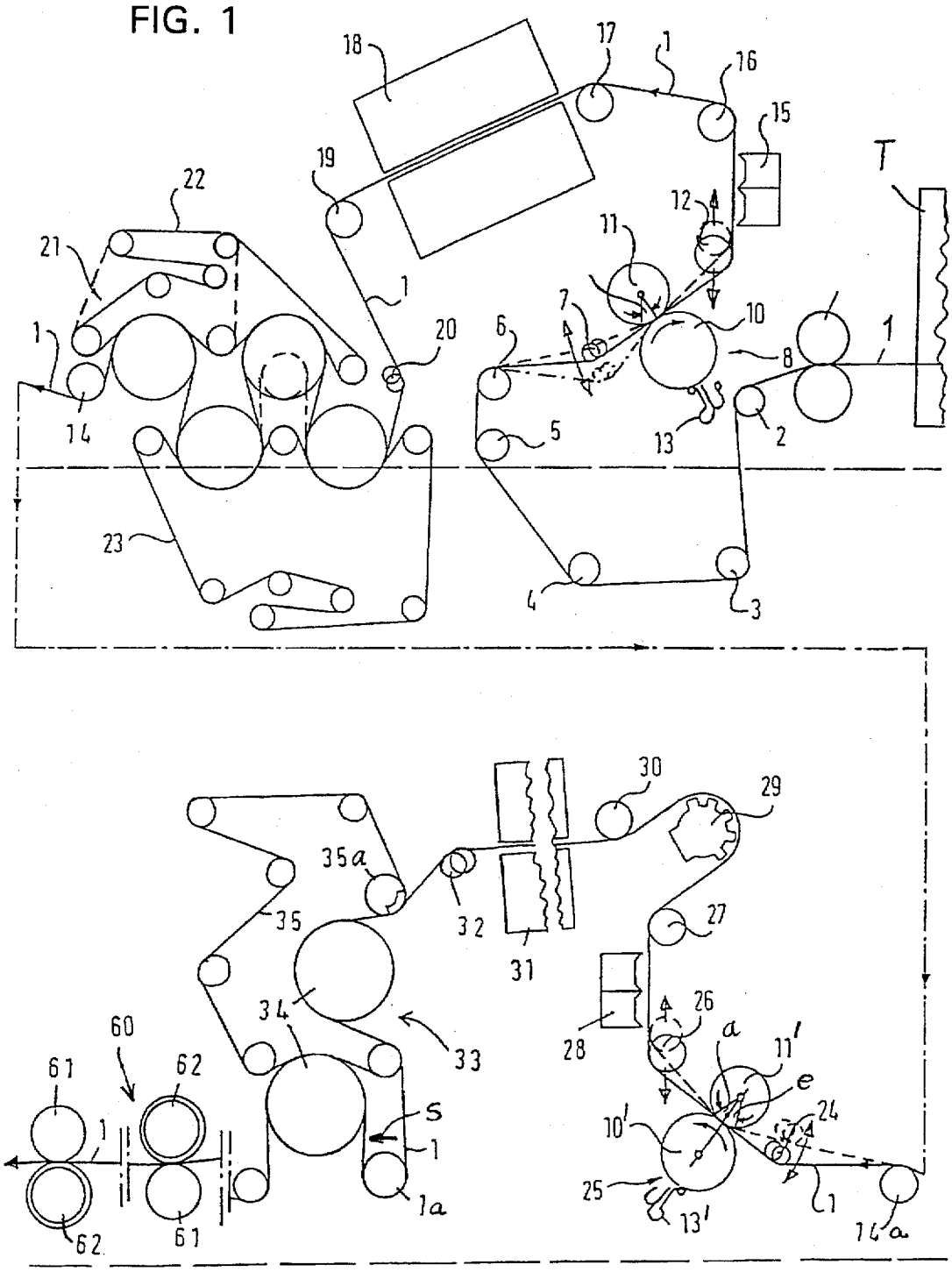
FIG. 1 shows a schematic side view of a part of a paper making machine with an on-line coating plant.

As illustrated in FIG. 1, after leaving a drying part T, the material web 1 runs through a calendering unit G and from there via web guiding rolls 2 to 6 into the area of a first coating station 8. Instead of the calendering unit G arranged in series after the drying part T, a calendering means (for example, a larger calendering and drying cylinder or "Yankee" cylinder) can also be provided within the drying part. A width stretching roll 7 arranged upstream of the first coating station 8 deflects the material web 1 out of a substantially horizontal running direction into a direction which passes upwards at an angle, after which the material web is guided through a coating nip formed in the coating station 8. The coating station 8 includes an application roll 10 and an opposing roll 11 arranged opposite the roll 10 and together with that roll forming an application nip, and an application unit 13. The application roll 10 includes a roll cover with a surface and the roll cover has a hardness in the range of 20 to 200 P&J and preferably in the range of 30 to 100 P&J. The roll cover is relatively soft while the opposing roll is a harder roll, which may be chrome plated. In the application nip between rolls 10 and 11, there is a line of force between the rolls of between 0 and 60 kN/m, and preferably between 5 and 20 kN/m. As shown in FIG. 1, the application roll 10 is preferably arranged at an angle away from directly beneath the opposing roll 11 so that the material web 1 runs at an angle from below to above through the application nip. However, instead of this, the arrangement can also be set up in such a manner that the web 1 runs substantially vertically from below to above through the application nip.

The position of the width stretching roll 7 is variable so that the web is wrapped somewhat around the opposing roll 11 before entering into the application nip, i.e. the web 1 covers a variable run-in angle e on the opposing roll 11 which can amount to between 0° and 15°. In another variation shown in dashed lines, the web is wrapped around a part of the application roll 10. As a result, the time of penetration of the coating medium into the web can be increased.

A web guiding roll 12 is arranged in series downstream of the coating station 8 and deflects the material web running out of the application nip, from its direction extending upwards at an angle, into a substantially, vertical upwards direction. The web guiding roll 12 in this case contacts the material web 1 on the side of the web which is not provided with a liquid medium (coating mass). The position of the web guiding roll 12 is also variable so that the web 1 covers a variable running out angle a on the opposing surface of the roll 11 which can amount to between 0° and 20° (see the lower half of FIG. 1).

After leaving the web guiding roll 12, the material web passes an infra red dryer 15 and is then guided through a hot air dryer 18 via two further web guiding rolls 16 and 17. Subsequently, the material web is supplied via a web guiding roll 19 and a width stretching roll 20 to a first contact drying cylinder arrangement 21 of known construction. This arrangement has a number of, for example, four drying cylinders against which the material web 1 is pressed in a known manner by means of a so-called top felt 22 and a bottom felt 23. A variant is indicated by the dashed lines in which only a single top felt cylinder is provided instead of two top felt cylinders.

After leaving the first contact drying cylinder arrangement 21, the material web 1 passes via further web guiding rolls 14, **14*a* and a width stretching roll 24 (again adjustable) into the area of a second coating station 25**.

This second coating station 25 is in the present exemplary embodiment designed in a substantially mirror-image form compared to the first coating station 8. The second coating station 25 comprises an application roll 10', an opposing roll 11' and an application unit 13'. Again, the width stretching roll 24 arranged upstream of the coating station deflects the material web out of a substantially horizontal running-in direction into an upwardly inclined running direction in which the material web passes through the application gap formed between the two rolls 10' and 11'. Analogously to the first coating station, the second coating station 25 has a web guiding roll 26 arranged downstream thereof which deflects the material web 1 running out of the pressing nip upwardly from its upwardly inclined running direction into a substantially vertical running direction.

After leaving the web guiding roll 26, the material web 1 passes an infra red dryer 28. Subsequently, the material web is introduced into a hot air drier 31 via a web guiding roll 27, a contact free operating deflection means 29 and a web guiding roll 30. After passing the hot air drier 31, the material web 1 runs via a width stretching roll 32 into a second contact drying cylinder arrangement 33 which can be structured in a similar manner to the first contact drying cylinder arrangement 21. However, there is illustrated a space-saving arrangement with only two approximately superimposed cylinders 34 having only a single felt 35 which, upstream of the first cylinder, runs over a suction guiding roll **35*a* where the felt 35 first contacts the web 1. Between the two cylinders 34, the web 1 can temporarily run without the felt 35 over a paper guiding roll 1*a* for the purpose of mounting a tail cutter S according to German patent application P 44 28 745.3 (PA10087). It is important that—directly or indirectly—a calendering unit, preferably a directly following on-line calendering unit 60, follows the drying cylinders 34. In comparison to an off-line calendering unit (75, FIG. 7**), an on-line calendering unit has amongst others the advantage that the input for the heat supply to the paper web in the calendering unit is smaller because the paper web already has a relatively high temperature before entering the calendering unit.

Two twin roll calendering units are preferably provided, each of which respectively has a nip formed by a relatively hard metal roll 61 capable of being heated to at least 130° C. and up to 400° C., and an opposing roll 62 with a "relatively soft" covering which is not capable of being heated. The soft roll has a Shore D hardness of at least 80. The finished paper web is then wound up in a commonly known manner (not shown in FIG. 1). The web is moved through the coating station nips and the calendering unit at an operating speed of at least 900 m/min and preferably at least 1100 m/min.

As may be taken from FIG. 1, the respective application units 13 and 13' of the coating stations 8 and 25 are arranged in the lower downwardly running quadrant of the application unit 10, namely approximately opposite the application nip. However, the application unit 13 can also be arranged approximately at the lower apex of the roll shell surface. As can be easily recognized in FIG. 1, in both coating stations 8 and 25, the liquid film applied onto the respective application roll 10 can be observed from below between the application unit 13 or 13' and the material web 1 and controlled in this manner.

Figure 2:
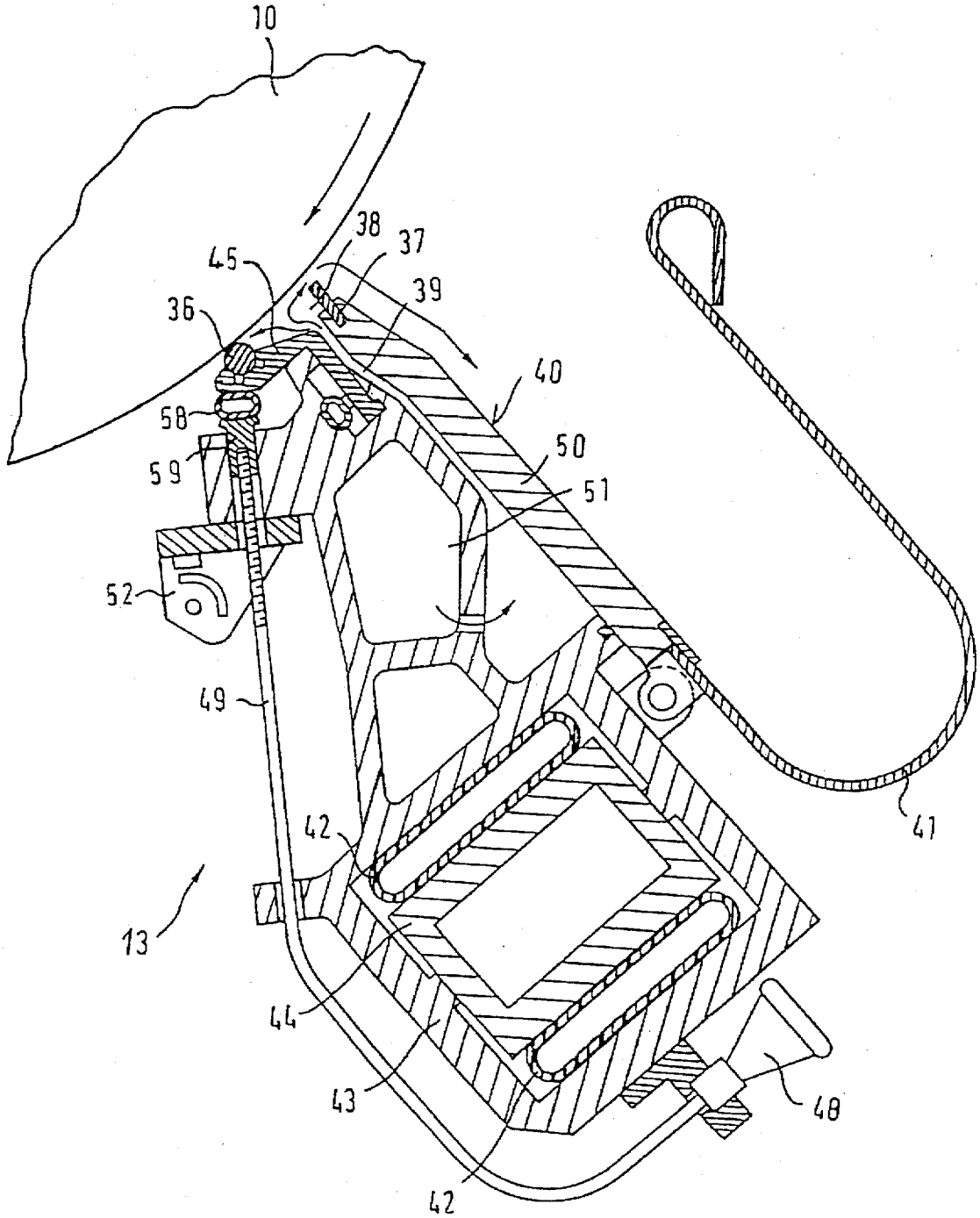

An application unit 13 is illustrated in FIG. 2 in a position relative to the application roll 10 which corresponds to the arrangement of the application unit 13 in the first coating station 8 in FIG. 1. The exemplary embodiment of the application unit 13 shown in FIG. 2 operates with a smooth roll doctor 36 which is mounted in a bent blade base 45 according to German patent application P 44 13 232.8 (PA10064). The liquid medium is supplied from a distribution channel 51 and through a supply gap 39 under pressure to an application chamber 38 which is bound by the roll doctor base 45, the application roll 10 and a damming strip 37. The liquid medium is applied with a desired coating thickness from the application chamber 38 onto the application roll 10. The coating mass of liquid medium that is applied to each application roll is selected with reference to characteristics of the rolls, the web and steps in the process such that an application weight of 2 to 20 g/m$^2$ and preferably 5 to 12 g/m$^2$, with respect to dry substance, is applied on each side of the web. The coating mass applied to the roll has a consistency of 25% to 75% solids material and preferably 45% to 65% solids. The material is selected to avoid formation of a spreading fog during coating. Excess liquid medium flows over the damming strip 37 (or through openings in the damming strip) and over the forward upstream wall 50 which carries it under the influence of gravity along a running off surface 40 into a discharge trough 41. As a consequence of the bent doctor base 45, the supply gap 39 and the running off surface 40 can extend approximately radially to the shell surface of the roll 10. This makes it possible to arrange the application unit in the lower downwardly moving quadrant of the roll 10.

The application unit 13 illustrated in FIG. 2 is provided with a known bending compensation system which by means of a measuring system 52 determines a bending of the beam 43 supporting the application unit and then carries out a bending compensation with the aid of pressure cushions 42 which are arranged between the beam 43 and a yoke 44 flexibly mounted therein.

Finally, the application unit includes a pressing tube 58 which extends across the entire width of the application unit 13 and contacts the bent doctor base 45. The pressing tube 18 is loaded by a pressing strip 59 which also extends continuously. Distributed along the width of the application unit 13 are spindle shafts 49 which are provided at their one end with a hand adjustment wheel 48 and are in effective connection at their other end with the pressing strip 59. The pressing tube 48, the pressing strip 59 and the adjusting spindles 49 which are designed as bendable shafts or as Cardan shafts form a system by means of which the pressing of the roll doctor 36 against the roll 10 can be variably adjusted along the width of the application unit in order to regulate the transverse profile of the coating film formed on the roll shell surface.

A further exemplary embodiment of an application unit 13A is shown in FIG. 3 and is suitable for positioning in the lower upwards moving quadrant of the application roll 10. The application unit 13A also operates with a smooth roll doctor 36. The liquid medium is supplied approximately tangentially to the roll shell surface through the supply gap 39' of the application chamber 38', which is bounded by a commonly known (essentially flat) roll doctor base 45', the application roll 10 and the damming strip 37'. Excess liquid medium flows over the damming strip 37' under the effect of gravitational force and along the running off surface 40 into a discharge trough 41.

Also in this case, a bending compensation system is provided which determines a bending of the beam 43 supporting the application unit by means of a measuring system and then carries out a bending compensation with the aid of pressing cushions 42 which are arranged between the beam 43 and a yoke 44 received in an articulated manner in this.

There is shown in FIG. 4 a further exemplary embodiment of an application unit 13B which is suitable for positioning in the lower upwardly moving quadrant of the application roll 10' of FIG. 1. This application unit is provided with a coating blade 36*a* (instead of a roll doctor). The coating blade 36*a* bounds an application chamber 38' together with a damming strip 37' and the application roll 10'. Liquid coating mass is again supplied under pressure to the application chamber, excess coating mass flowing over the damming strip 37' along a running off surface 40 into a collecting trough 41. The application unit 13B shown in FIG. 4 is formed without a bending compensation apparatus.

Naturally, the application units 13 and 13' respectively used in the two coating stations 8 and 25 of the coating plant illustrated in FIG. 1 can be of the type shown in FIG. 2 or of that in FIG. 3 and must merely be appropriately adapted in terms of their spatial positioning to the first and second coating stations. Additionally, the respectively used application units 13 and 13' can also be altered further in comparison to the embodiments shown as examples in FIGS. 2 and 3.

Figure 5:
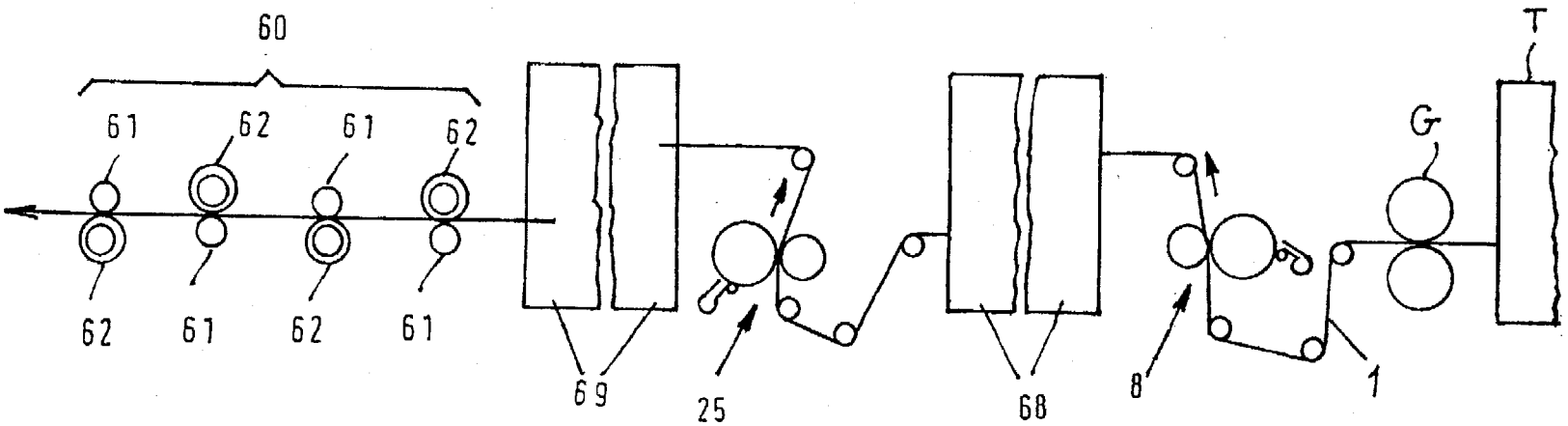
FIGS. 5–7 show variants with different calendering means.

FIG. 5 differs from FIG. 1 in terms of the following:

The paper web 1 runs substantially vertically from below to above through the roll nips of the coating stations 8 and 25. There is provided following each coating station 8, 25 any desirable, merely symbolically illustrated drying station 68, 69. The on-line calendering unit includes in total four twin-roll calenders with respectively one hard and heatable roll 61 and one "relatively soft" roll 62 which is not capable of being heated. Each roll type 61 or 62 is arranged alternately at the bottom and the top so that a symmetric calendering of the web 1 takes place.

Figure 6:
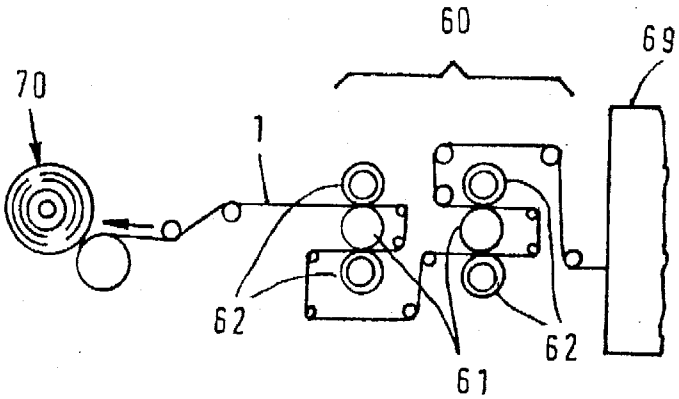

FIG. 6 shows a variant in which the on-line calendering unit 60 has two triple roll calenders respectively comprising a central heatable hard roll 61 and two "relatively soft" opposing rolls 62. A winding station 70 follows the calendering unit 60.

Figure 7:
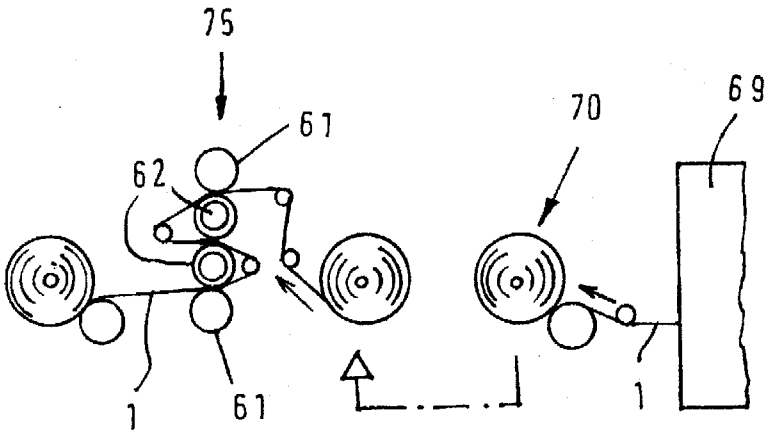

In accordance with FIG. 7, a winding station 70 is arranged directly after the drying station 64. In this case, the calendering of the completed and coated paper web 1 takes place in an off-line calendering unit 75 operating independently of the paper making machine. It is also provided in this case that each paper side is placed in contact with a hard heatable roll 61 and with a "relatively soft" opposing roll 62 not capable of being heated. With the invention, the finished coated paper web has a quality value (Qw) of 0.3 to 2.4, preferably 0.6 to 1.8, the quality value (Qw) being determined according to the following formula:

$$Qw = M[g/m^2] \cdot \sqrt{\text{smoothness accord. to } PPS\ 10S[\mu m]} \ / \sqrt{\text{gloss}[\%]}\ ,$$

(M being the application weight per web side, with respect to the dried substance, and a measuring value according to Hunter, for example at 75 degrees, or Lehmann being used for the gloss).

We claim:

1. Apparatus for coating a web which has been dried in a paper making machine, the apparatus comprising;

means for guiding a paper web along a path; a first coating station located at and being for indirectly coating one side of the paper web and a second coating station located at and being for indirectly coating the other side of the paper web, the second coating station being disposed downstream of the first coating station along the path of the web;

each of the first and second coating stations comprising:

a rotatable application role having a peripheral surface for receiving a coating mass and for rotating into contact with the respective side of the web for applying coating on the respective side of the web;

an opposing element opposing the respective application roll for defining a respective application nip through which the web passes and in which the application roll applies the coating mass to the respective side of the web; and a smooth doctor element at the application roll spaced around the roll away from the nip, and the doctor element being smooth for metering the coating film on the surface of the respective application roll;

the apparatus further comprising respective first and second drying means downstream of the first and second coating stations, for drying the material coated on the web, the first drying station being between the first and second coating stations along the path of the web;

a calendering unit downstream in the path of the web from the second drying means of the second coating station.

2. The apparatus of claim 1, wherein the smooth doctor element comprises a smooth roll doctor.

3. The apparatus of claim 1, wherein the smooth doctor element comprises a smooth coating blade.

4. The apparatus of claim 1, wherein each of the application rolls includes a roll cover having the surface, the cover having a hardness in the range of 20 to 200 P&J.

5. The apparatus of claim 4, wherein the roll cover has a hardness in the range of 30 to 100 P&J.

6. The apparatus of claim 1, wherein each of the application rolls has a roll cover that is relatively soft, and each of the opposing elements comprises a hard opposing roll.

7. The apparatus of claim 6, wherein each of the opposing elements comprises a chrome plated opposing roll.

8. The apparatus of claim 1, further comprising a respective web guiding roll disposed in the web path following each of the application nips, wherein each of the web guiding rolls is variable in position so that the running out angle of the web path wrapping around the opposing element is variable in the range between 0° and 20°.

9. The apparatus of claim 1, further comprising a respective width stretching roll disposed upstream of each application nip with respect to the direction of movement of the web.

10. The apparatus of claim 9, wherein each of the width stretching rolls is so positionable and is variable in position such that the running in angle of the web path around the opposing element is variable between 0° and 15°.

11. The apparatus of claim 1, wherein each coating station further comprises an application unit located at the surface of the respective roll, the application unit comprising:

the respective doctor element;

a damming strip spaced at a distance from the doctor element in the direction opposite the direction of rotation of the roll, wherein the damming strip provides one boundary of an application chamber, the doctor element provides another boundary thereof and the surface of application roll provides another boundary thereof and wherein the application unit includes a running off surface directed with respect to the application chamber for directing excess coating mass medium flowing out of the application chamber away under the influence of gravity.

12. The apparatus of claim 11, wherein the peripheral surface of the application roll has a downwardly moving area as it is rotating away from the nip and has an upwardly moving area as it is rotating toward the nip; and the application unit of at least one of the application rolls is arranged in the downwardly moving area of the application roll surface.

13. The apparatus of claim 12, wherein the application unit is arranged at that section of the roll surface of the roll that moves downward and that lies beneath the horizontal plane extending through the axis of the roll.

14. The apparatus of claim 1, wherein at at least one of the coating stations, the respective application roll and the opposing element are so positioned that the web passes substantially from below to above through the nip.

15. The apparatus of claim 14, wherein the respective application roll and opposing element are so positioned that the web passes through the nip from below to above at an angle to the vertical.

16. The apparatus of claim 1, wherein the calender unit comprises at least two roll nips, each formed by and comprised of a hard heatable roll and a relatively soft roll which together define a nip through which the web passes, wherein the one side of the web contacts the hard heatable roll in one of the nips and the other side of the web contacts the heatable roll in the other of the nips.

17. The apparatus of claim 16, wherein the relatively soft rolls have a Shore D hardness of at least 80.

* * * * *